US010935299B2

(12) United States Patent
Davis

(10) Patent No.: US 10,935,299 B2
(45) Date of Patent: Mar. 2, 2021

(54) QUICK FREEZE COOLER

(71) Applicant: Cedric Davis, Arlington, TX (US)

(72) Inventor: Cedric Davis, Arlington, TX (US)

( * ) Notice: Subject to any disclaimer, the term of this patent is extended or adjusted under 35 U.S.C. 154(b) by 18 days.

(21) Appl. No.: 16/006,869

(22) Filed: Jun. 13, 2018

(65) Prior Publication Data

US 2019/0383545 A1 Dec. 19, 2019

(51) Int. Cl.

| | |
|---|---|
| ***F25D 3/12*** | (2006.01) |
| ***F25D 3/04*** | (2006.01) |
| ***F25D 23/12*** | (2006.01) |
| ***F25B 19/00*** | (2006.01) |
| ***F25D 29/00*** | (2006.01) |

(52) U.S. Cl.

CPC ..... *F25D 3/122* (2013.01); *F25B 19/005* (2013.01); *F25D 3/04* (2013.01); *F25D 23/12* (2013.01); *F25D 29/001* (2013.01); *F25D 29/008* (2013.01); *F25D 2303/082* (2013.01); *F25D 2400/28* (2013.01); *F25D 2600/02* (2013.01); *F25D 2700/12* (2013.01); *F25D 2700/14* (2013.01); *F25D 2700/16* (2013.01)

(58) Field of Classification Search

CPC . F25D 3/10; F25D 3/102; F25D 3/105; F25D 3/107; F25D 3/122; F25D 2303/082

See application file for complete search history.

(56) References Cited

U.S. PATENT DOCUMENTS 4,404,813 A * 9/1983 Paddock ..... F25D 29/005 165/11.1
5,505,054 A 4/1996 Loibl
5,671,611 A * 9/1997 Quigley ..... F25D 3/08 62/457.7
5,775,124 A * 7/1998 Park ..... F25D 17/045 62/408
5,798,694 A * 8/1998 Reber ..... B65D 77/24 340/10.41
5,826,432 A 10/1998 Ledbetter
6,212,901 B1 4/2001 Pint (Continued)

FOREIGN PATENT DOCUMENTS

EP 1074803 A2 8/1999
JP 2002277157 A * 9/2002

OTHER PUBLICATIONS

Server Products, Inc., Server 86070 Cold Food Holding Countertop Chiller, https://www.katom.com/003-86070.html, https://d3ld6frh4bdurh.cloudfront.net/pdf/003-86070.pdf, 2018, p. 1, Katom Restaurant Supply, Richfield, WI, USA.

(Continued)

*Primary Examiner* — Nelson J Nieves

(74) *Attorney, Agent, or Firm* — Gregory M. MacDonald, Esq.

(57) ABSTRACT

The present invention involves using either liquid nitrogen, dry ice, a gel-like solution of water and alcohol in an ice pack, or a combination of these in a method or device for rapidly lowering the temperature of multiple food and beverage products at the same time. The gel-like ice pack may be shaped around the food or beverage product to increase the surface area resulting in faster cooling. The device may also contain a scale, infrared temperature sensor, and bar code scanner for determining the initial weight, temperature, density, and type of food or beverage product to be cooled.

7 Claims, 7 Drawing Sheets

(56) References Cited

U.S. PATENT DOCUMENTS 6,550,259 B2 4/2003 Cartwright
7,138,586 B1 * 11/2006 Kim ..... F25D 23/12 177/126
7,146,826 B1 * 12/2006 Schlosser ..... F25D 31/007 62/457.9
10,393,415 B1 * 8/2019 Partee ..... H02J 7/355
2003/0066639 A1 * 4/2003 Wang ..... F25D 3/10 165/263
2004/0216470 A1 * 11/2004 Thomas ..... F25D 3/11 62/63
2006/0027567 A1 * 2/2006 Biscotti ..... A23L 3/36 219/497
2007/0006604 A1 * 1/2007 Behr ..... A47F 3/0443 62/246
2007/0051734 A1 * 3/2007 Kuhn ..... F25D 3/06 220/592.27
2007/0151774 A1 * 7/2007 Deng ..... G01G 19/52 177/181
2007/0227161 A1 * 10/2007 Boer ..... F25D 29/00 62/56
2008/0104976 A1 * 5/2008 Guglielmetti ..... F25D 29/001 62/127
2008/0115511 A1 * 5/2008 Barone ..... F25D 29/00 62/62
2009/0064690 A1 * 3/2009 Girard ..... F25D 16/00 62/62
2009/0084113 A1 * 4/2009 Jeuch ..... F25B 21/02 62/3.6
2011/0232303 A1 * 9/2011 Whewell, Jr. ..... F25D 3/122 62/62
2012/0028560 A1 * 2/2012 Nikolic ..... F24F 11/70 454/239
2013/0111931 A1 * 5/2013 Grinter ..... F25D 13/00 62/62
2014/0070951 A1 * 3/2014 Shim ..... F25D 29/00 340/585
2014/0148969 A1 * 5/2014 Graziano ..... H04L 67/125 700/300
2015/0192340 A1 * 7/2015 Andrews ..... F25D 3/08 62/457.5
2015/0204598 A1 * 7/2015 Affleck ..... B65B 3/003 700/228
2015/0260450 A1 * 9/2015 Marutani ..... G08B 21/02 62/131
2016/0089262 A1 * 3/2016 Kuehne ..... A61F 7/0053 606/20
2017/0176096 A1 * 6/2017 Lundberg ..... F25B 21/02
2017/0263100 A1 * 9/2017 Johnston ..... F25D 11/00
2017/0321947 A1 11/2017 Zvida
2018/0141718 A1 * 5/2018 Ahlstrom ..... A45F 3/46
2018/0271322 A1 * 9/2018 Thai ..... A47J 31/002
2019/0170626 A1 * 6/2019 Kravtsov ..... F25D 3/107
2019/0210790 A1 * 7/2019 Rizzo ..... B65D 81/18
2019/0331410 A1 * 10/2019 Li ..... F25D 29/008

OTHER PUBLICATIONS

Summit Appliance, Countertop Impulse Freezer w/ Self-Closing Door, https://www.amazon.com/Summit-Countertop-Impulse-Freezer-Self-Closing/dp/B009Z2CE94, 2018, p. 1, Direct Distributors through Amazon.com, Bronx, NY.

Cooper Cooler, Cooper Cooler HC01—A Rapid Beverage & Wine Chiller, https://www.amazon.com/Cooper-Cooler-HC01-Beverage-Chiller/dp/B0007LJNB4, 2018, p. 1, Poughkeepsie, NY.

* cited by examiner

QUICK FREEZE COOLER

CROSS-REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR

Not Applicable

BACKGROUND

Unless otherwise indicated herein, the materials described in this section are not prior art to the claims in this application and are not admitted to be prior art by inclusion in this section.

1. Field of the Invention

The present invention relates generally to refrigeration. More specifically, the present invention relates to a household cooling device for rapidly cooling food and beverages.

2. Description of Related Art

People often find themselves looking for ways to preserve foods for extended periods of time. Food preservation has been essential for human survival for centuries. Ancient methods of cooling developed based on cold winter temperatures and the availability of snow and ice.

Before mechanical refrigeration, ice harvesting was used to maintain cold temperatures for extended periods of time. This type of refrigeration led to the development of railroad cars with dedicated ice compartments to allow for the transportation of perishable goods over extended distances.

Before refrigeration, the human diet was highly influenced by climate and seasons. During cold winter months, fresh produce was not readily available. Thus, people had to rely largely on other preservation methods. The increased use of electrical power allowed refrigeration systems to be introduced at both the industrial level, as well as at the private level. Refrigerators and freezers allow products to be stored longer and transported over longer distances. This allowed certain foods and beverages to be available in areas where storage due to climate was previously an issue.

With the development of technological advancements, modern life relies on this convenience to ensure a comfortable lifestyle. Fresh produce, such as fruits and vegetables, are now widely available year-round, even in climates where it is not possible to grow such products during certain months of the year.

Although household storage of products became increasingly popular with the widespread availability of refrigeration units, problems still arise when perishable foods are improperly stored. This may lead to the development of foodborne illness caused by bacteria.

According to the United States Department of Agriculture Food Safety and Inspection Service, leaving food out for too long at room temperature can cause bacteria (such as *Staphylococcus aureus, Salmonella Enteritidis, Escherichia coli* 0157:H7, and *Campylobacter*) to grow to dangerous levels that can cause illness. Bacteria grows most rapidly in the range of temperatures between 40° F. and 140° F., doubling in number in as little as 20 minutes. This range of temperatures is often called the "Danger Zone." If food remains for extended periods of time in the Danger Zone, it may become unfit for human consumption.

To ensure that food products remain safe, they must be properly preserved. Household refrigerators may not cool hot foods fast enough to overcome an extended period of time in the Danger Zone. Also, consumers may desire a faster cooling device or method to maintain the freshness of food products and to cool beverages to a more desirable temperature for drinking.

Conventional cooling methods are expensive, inefficient, slow, and require a large amount of electrical power and space. Thus, the need exists for a device to cool a food or beverage product that is inexpensive, efficient, quick, compact, and requires little or no electrical power.

BRIEF SUMMARY OF THE INVENTION

It is a principal object to solve at least one of the disadvantages with other attempted solutions or to create other utility by providing a rapid cooling device or method to cool food or beverages that is inexpensive, efficient, quick, compact, and requires little or no electrical power.

The present invention involves using either liquid nitrogen, a solid form of carbon dioxide that is commonly referred to as "dry ice", a water and alcohol solution in a gel-like ice pack, or a combination of these in a rapid cooling device or method comprising multiple components for rapidly lowering the temperature of multiple food and beverage products at the same time. Either the liquid nitrogen or the dry ice may be used to cool the gel-like ice pack, which may be shaped around the food or beverage product to increase the surface area between the product and the gel-like ice pack resulting in faster cooling.

Other objectives and advantages of the present invention will become apparent from the following detailed description when viewed in conjunction with the accompanying drawings, which set forth certain embodiments of the invention.

BRIEF DESCRIPTION OF THE DRAWINGS

The accompanying drawings, which are incorporated in and constitute a part of this specification, illustrate several aspects described below.

DETAILED DESCRIPTION OF THE INVENTION

Figure 1:
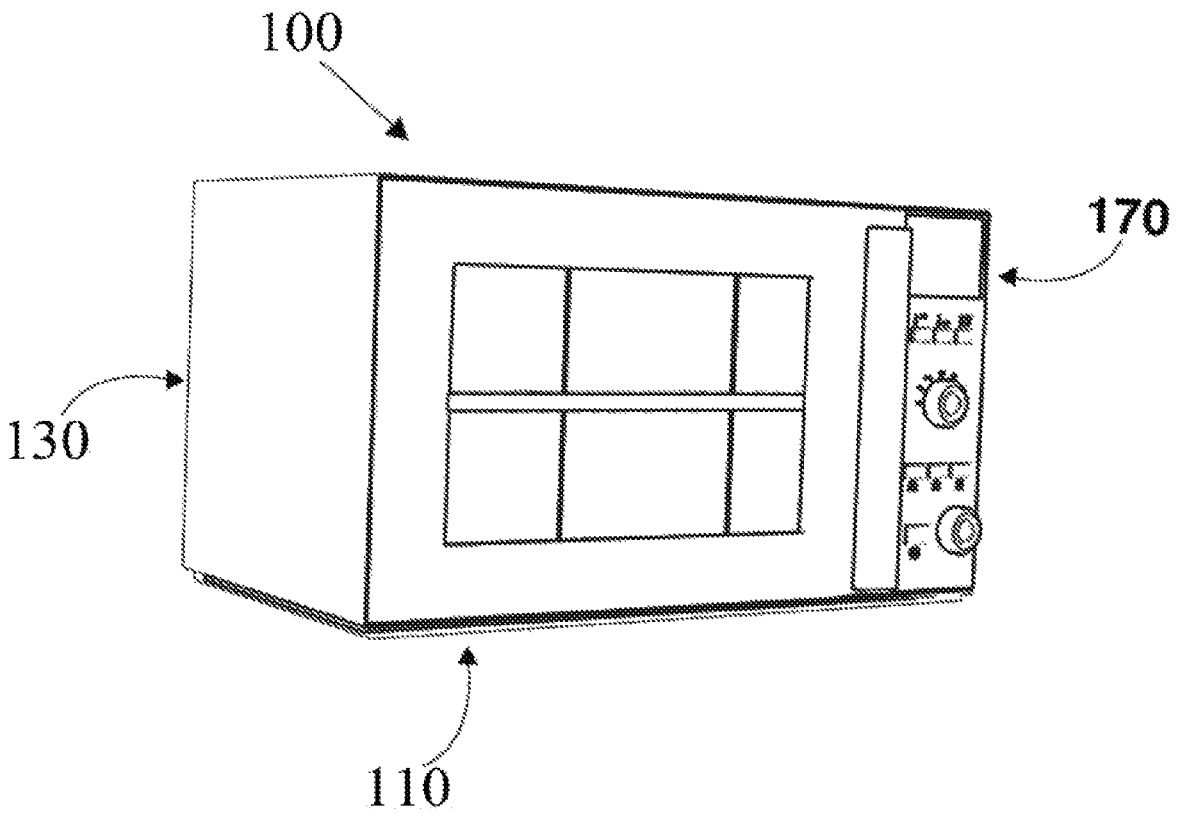
FIG. 1 is a front isometric view of the present invention with the access door closed in which at least one of the embodiments of the present invention is shown.

It is to be understood that this invention is not limited to any particular embodiment described, which may vary. Also, it is to be understood that the terminology used herein is for the purpose of describing particular embodiments only, and is not intended to be limiting, since the scope of this invention will be limited only by the appended claims.

In the following detailed description, numerous specific details are set forth in order to explain and provide a thorough understanding of the present invention. However, it is apparent that the present invention may be practiced without all of these specific details. Thus, all illustrations of the drawings are for the purpose of describing versions of the present invention, and are not intended to limit the scope of the invention.

In the following section, the present invention is described fully by referencing the details in the enclosed drawings, which illustrate certain embodiments of the invention. The numbers shown in this specification refer to the corresponding numbers in the enclosed drawings. The terminology used is to describe the particular embodiment shown and is not intended to limit the scope of the invention. The invention may also be embodied in many other forms in addition to the embodiments shown. Thus, the embodiments shown should not be construed as limiting, but rather, to allow a thorough and complete description of the disclosure that conveys the scope of the invention to a person having ordinary skill in the art in the field of this invention. Therefore, for the terms used herein, the singular forms "the," "a," and "an" are intended to include the plural forms as well as the singular forms, unless the context clearly indicates otherwise. The term "and" includes any and all combinations of one or more of the associated listed items. As used herein, the terms "comprising" and "comprises" when used in this specification, identify specific steps, integers, operations, features, components, and elements, but do not preclude the presence or addition of one or more other steps, operations, features, components, and elements. In addition, the features, components, and elements referenced may be exaggerated for clarity.

Unless otherwise defined, all scientific terms, technical terms, or other terms used herein have the same meaning as the term that is understood by one having ordinary skill in the art in the field of this invention. It is also understood that these terms, including their dictionary meaning, should be understood as having the meaning, which is consistent with their definitions in the related relevant art. In addition, the present disclosure is not to be interpreted in an idealized or overly formal sense unless expressly stated so herein. Constructions or functions that are well known in the art may not be fully described in detail for brevity.

In describing the invention, it is understood that a number of steps and methods may be disclosed. Each of these may have individual benefit. Also, each may be used in conjunction with at least one or more of the disclosed steps and methods. Therefore, this description will refrain from stating each and every possible combination of the individual steps and methods for the sake of brevity. Regardless, the specification and related claims should be understood with the combinations that are entirely within the scope of the claims and inventions.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

The disclosure in this invention are examples of how it may be implemented and are not intended to limit the scope of the invention to the specific embodiments shown in the accompanying drawings or the description provided herein. The present invention will now be described by example in the following paragraphs by referencing the accompanying drawings, which represent embodiments and alternative embodiments.

In reference to FIG. 1, the present invention is a rapid cooling system or device 100 for rapidly cooling food and beverage products, comprising an insulated container with a top, bottom, and four sides, where one side comprises a door 110. The cooling device 100 is shown in FIG. 1 with the access door 110 closed. The door 110 of the device 100 may be positioned on the front or any side 130 of the device 100. The side 130 or the bottom of the device 100 may provide an opening to allow dry ice or the food or beverage product to be ejected after the desired temperature is achieved. The frame of the door 110 may be comprised of insulation materials to minimize heat transfer through the opening.

The device 100 of the present invention may be either wall mounted or placed on a shelf, counter, or other flat surface. Attachment points may be positioned on the back or bottom of the device 100. The general shape and size of the device 100 of the present invention may be about 8-inches to 18-inches tall, 8-inches to 18-inches deep, and about 8-inches to 24-inches wide.

The temperature of various food and beverage products may be rapidly lowered by placing them inside of the device 100 for a relatively short amount of time. These items may become frozen, if desired, by leaving them inside of the device 100 for a longer period of time. The final temperature of a food or beverage product is calculated by an algorithm run by a microprocessor within the device 100. The algorithm considers the initial temperature of the food or beverage product, its weight, its density, and the initial temperature within the device 100. The algorithm determines the amount of time that the food or beverage product needs to be left inside of the device 100 while being exposed to a cooling agent, such as liquid nitrogen or a solid form of carbon dioxide that is commonly referred to as "dry ice", to reach the desired temperature. The longer the food or beverage product is kept inside of the device 100, the more its temperature is lowered towards the temperature within the device 100.

In at least one embodiment of the invention, as shown in FIG. 1, the device 100 may contain a display panel 170. The display panel 170 may be capable of displaying the time of day, the time left until the desired temperature of the food or beverage product is achieved, the current temperature within the device, the temperature of the food or beverage product being cooled, and other useful information. Also, in at least one embodiment of the invention, the device 100 may contain other control knobs on the front of the device 100, which may be located under the display panel 170. These control knobs may be capable of adjusting the time for the food or beverage product to be cooled, along with its weight, initial temperature, and the type of food or beverage product to be cooled. For example, there may be a setting labelled either "Coke," "Soda," "Pop," of another indicator for a carbonated beverage. When this setting is selected, the device 100 will rapidly lower the temperature of a beverage product to a predetermined temperature above freezing to prevent the product from freezing, expanding, or exploding.

Figure 2:
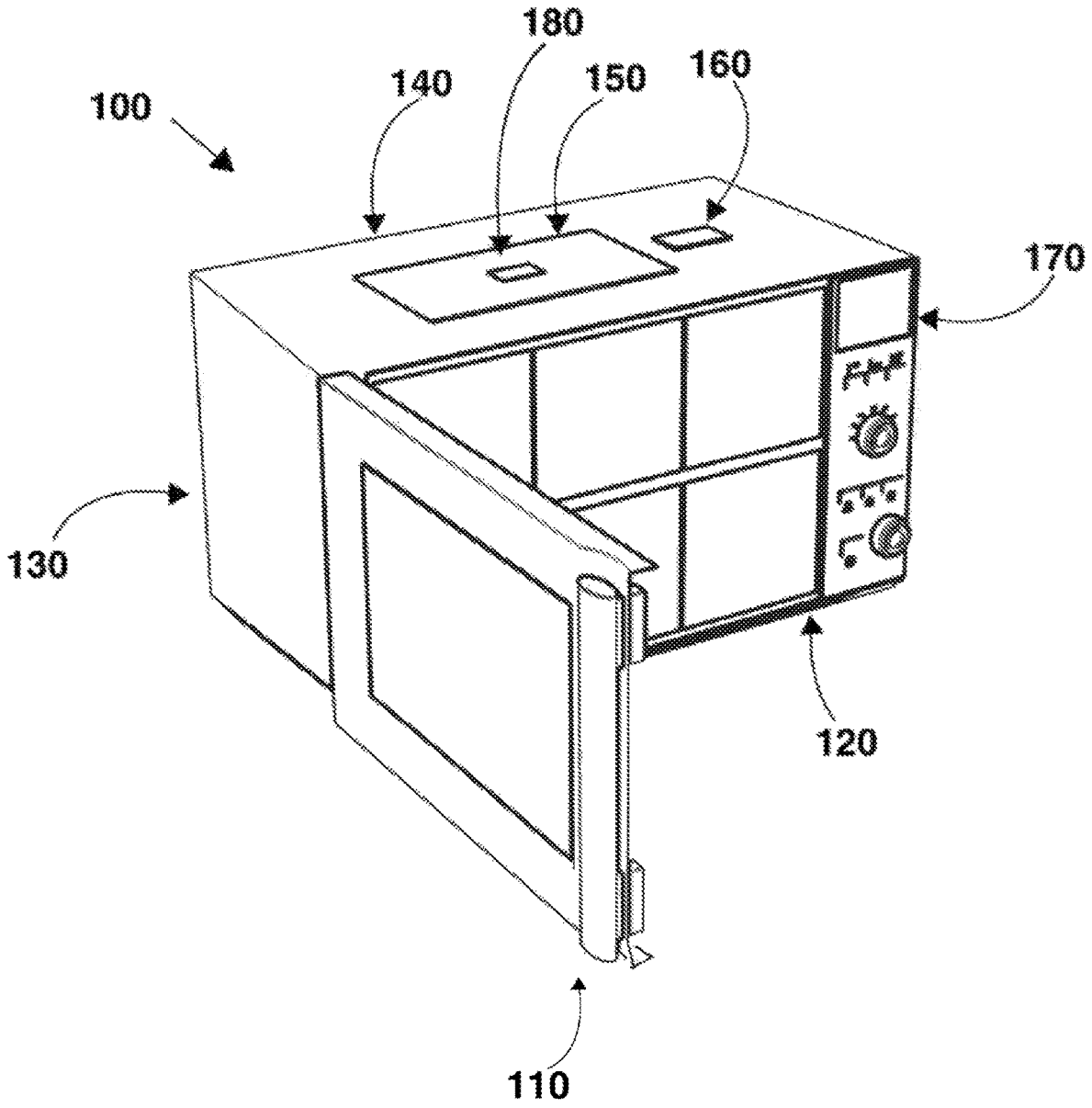
FIG. 2 is a front top isometric view of the present invention with the access door open in which at least one of the embodiments of the present invention is shown.

In reference to FIG. 2, a front top isometric view of the device 100 is shown with the access door 110 open. The device 100 comprises at least one cooling compartment 120 for holding either a food or beverage product, so that it may be rapidly cooled. The embodiment shown in FIG. 2 of device 100 shows a total of six cooling compartments 120 that are arranged in two rows and three columns. However, these cooling compartments 120 may be of any number and arranged in any configuration.

In at least one embodiment of the invention, the outer walls of each cooling compartment 120 may contain at least one void or sleeve in its bottom or one of its sides, which may contain one or more cooling agents. The cooling agent used for the device 100 may be either liquid nitrogen ("LN2"), dry ice, a solution of water and alcohol in a gel-like ice pack, or a combination of these depending on the application. The solution of water and alcohol in the gel-like ice pack may be cooled by either dry ice or LN2.

The LN2 may flow directly into one of the cooling compartments 120 or into a sleeve around the cooling compartments 120. Similarly, the dry ice may be placed either directly in the bottom of one of the cooling compartments 120 or in a sleeve around the cooling compartment 120. Also, similarly, the gel-like ice pack may be placed in the bottom of one of the cooling compartments 120 or in a sleeve around the cooling compartment 120. When the gel-like ice pack is placed in the bottom of one of the cooling compartments 120, and the user places a food or beverage product into a compartment 120 on top of the gel-like ice pack, the weight of the product will cause the gel-like ice pack to deform or mold around the food or beverage product to increase the surface area between the product and the gel-like ice pack, which will reduce the amount of time required for the product to reach its desired temperature.

FIG. 2 also shows the location of one of the sides 130 of the device and the top 140 of the device. The top 140 of the device shows the location of a scale 150. The scale 150 may include a bar code scanner 180 to determine the type of product. The top 140 of the device also shows an infrared temperature sensor 160 for determining the initial temperature of the food or beverage product. In addition, as shown in FIG. 2, the device 100 may contain a display panel 170.

In at least one embodiment of the present invention, as seen in FIG. 2, the scale 150, bar code scanner 180, and infrared temperature sensor 160 may be integrated into the top 140 of the device 100 for a user to weight the product, determine its type and density, and determine its initial temperature. This information would then be used by the algorithm to determine the approximate density of the product to allow for a more accurate estimate of the time required for the product to reach the desired temperature. Otherwise, if a barcode scanner 180 is not used, the product would be assumed to have the same density as water or another predetermined density.

In at least one embodiment, the scale 150, bar code scanner 180, and infrared temperature sensor 160 may be combined together so that the initial weight, initial temperature, density, and type of food or beverage product may be determined by the user placing the product on the top of the device 100.

The initial weight, initial temperature, density, and type of food or beverage product may be used by the algorithm, which is run by a microprocessor to calculate the amount of time that a food or beverage product should remain inside the device 100 for the product to reach the desired final temperature.

The infrared temperature sensor 160 may be capable of determining the initial temperature of the item in the range of approximately 32° F. to 212° F. The algorithm may consider the initial temperature of the product from either the infrared temperature sensor 160 or an input entered by the user. Alternatively, a default setting may be provided by way of the control panel 170 that allows the user to select a predetermined setting. For example, a default setting labeled "cold" may cause the temperature of the item to be lowered to about 40° F. By way of another example, a setting labeled "freeze" may lower the temperature of a product placed inside the device 100 to 20° F. or another preprogrammed temperature.

In at least one embodiment of the present invention, the door 110 of the device 100 may automatically open, if the user does not remove the food or beverage product from the device 100 within a predetermined amount of time after a visual or audible alarm sounds from the timer of the device 100.

In another embodiment of the present invention, the product may be ejected from the bottom or a side of the device 100 if the user does not remove it from the device 100 within a predetermined amount of time after a visual or audible alarm sounds from the timer of the device 100.

In another embodiment of the present invention, the dry ice may be ejected from the bottom or a side of the device 100 when the food or beverage product reaches the desired temperature to avoid the food product from cooling to a temperature that is too low.

In another embodiment of the present invention, the gel-like ice pack is ejected from the bottom or a side of the device 100 when the food or beverage product reaches the desired temperature to avoid the food product from cooling to a temperature that is too low.

In yet another embodiment of the present invention, the flow of LN2 into the device 100 may cease when the timer indicates the product has likely reached its desired temperature.

In yet another embodiment of the present invention, a fan may turn on when the timer ends, which will draw warmer surrounding air into the device 100 to the assist in raising the temperature within the device 100 so that the product does not reach a temperature lower than desired.

Figure 3:
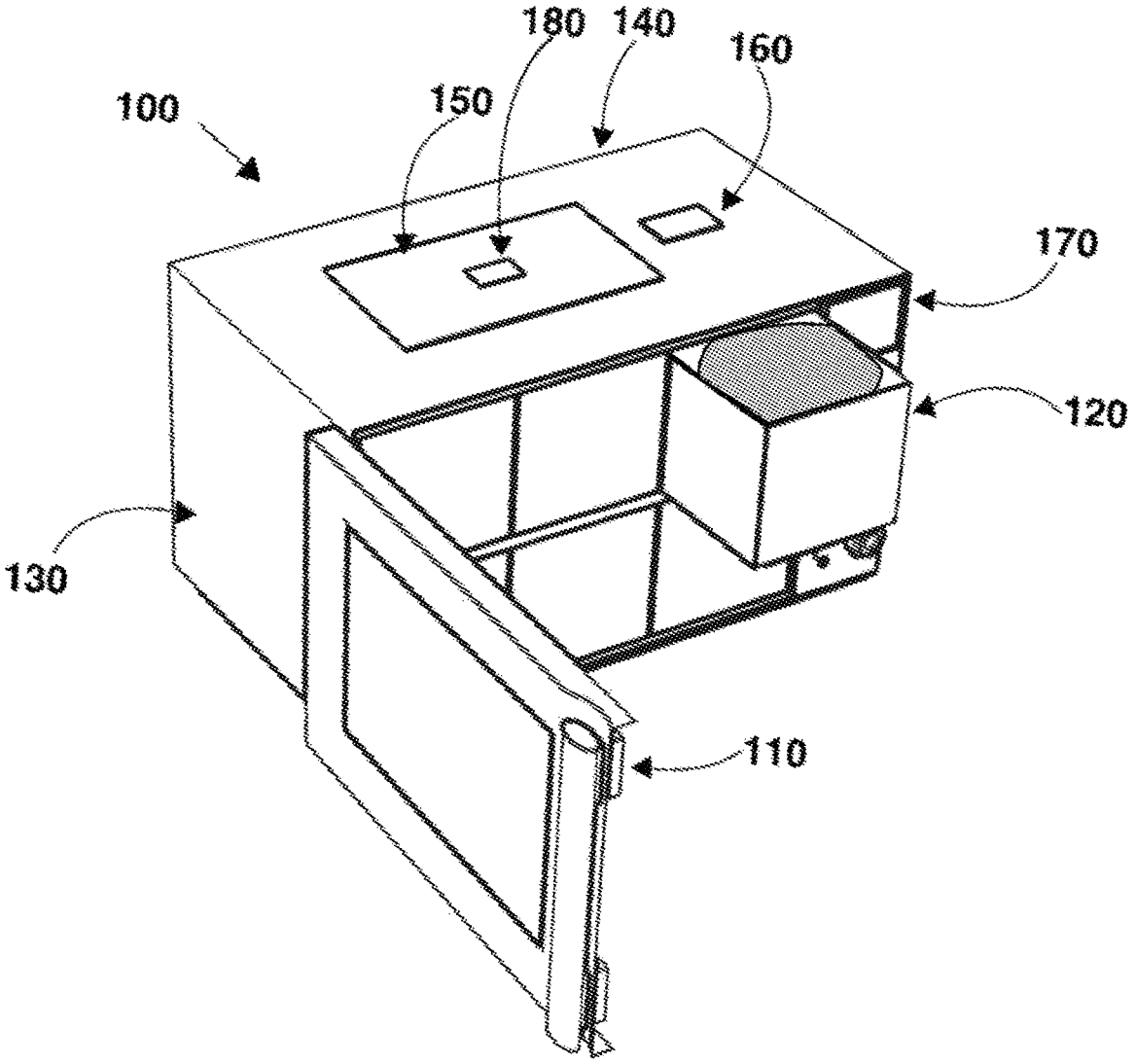
FIG. 3 is a front top isometric view of the present invention with the access door open and one of the cooling compartments drawn into an open position in which at least one of the embodiments of the present invention is shown.

As shown in FIG. 3, the device 100 is shown with the access door 110 open. One cooling compartment 120 is withdrawn to allow a food or beverage item to be inserted or removed. The cooling compartment 120 is able to slide in and out of the device 100. Also, FIG. 3 shows the location of one of the sides 130 of the device and the top 140 of the device. The top 140 of the device shows the location of a scale 150, bar code scanner 180, and an infrared temperature sensor 160. In addition, as shown in FIG. 3, the device 100 may contain a display panel 170.

In at least one embodiment of the invention, as shown in FIG. 3, the interior walls of the device 100 may comprise sleeves or slots that facilitate the insertion of a plurality of cooling compartments 120. The cooling compartments 120 may be placed inside the device 100, so that the user may place various objects inside that desire fast cooling.

In at least one embodiment of the present invention as shown in FIG. 3, there may be a scale 150 integrated into the device 100 to determine the weight of a food or beverage item. In at least one embodiment of the present invention, there may be an infrared or other type of temperature sensor 160 integrated into the device 100 to determine the initial temperature of the food or beverage item. A barcode scanner may also be installed on top of the device 100 or within the scale 150.

Figure 4:
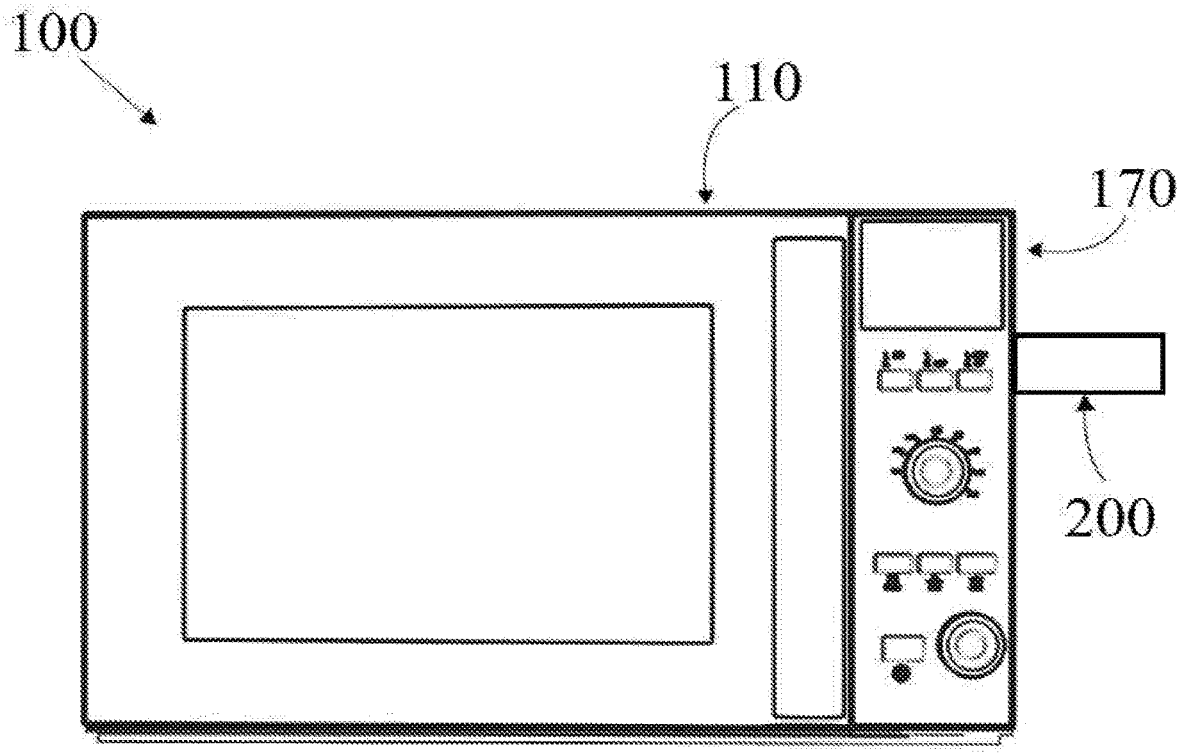
FIG. 4 is a front view of the present invention with the access door closed in which at least one of the embodiments of the present invention is shown.
Figure 5:
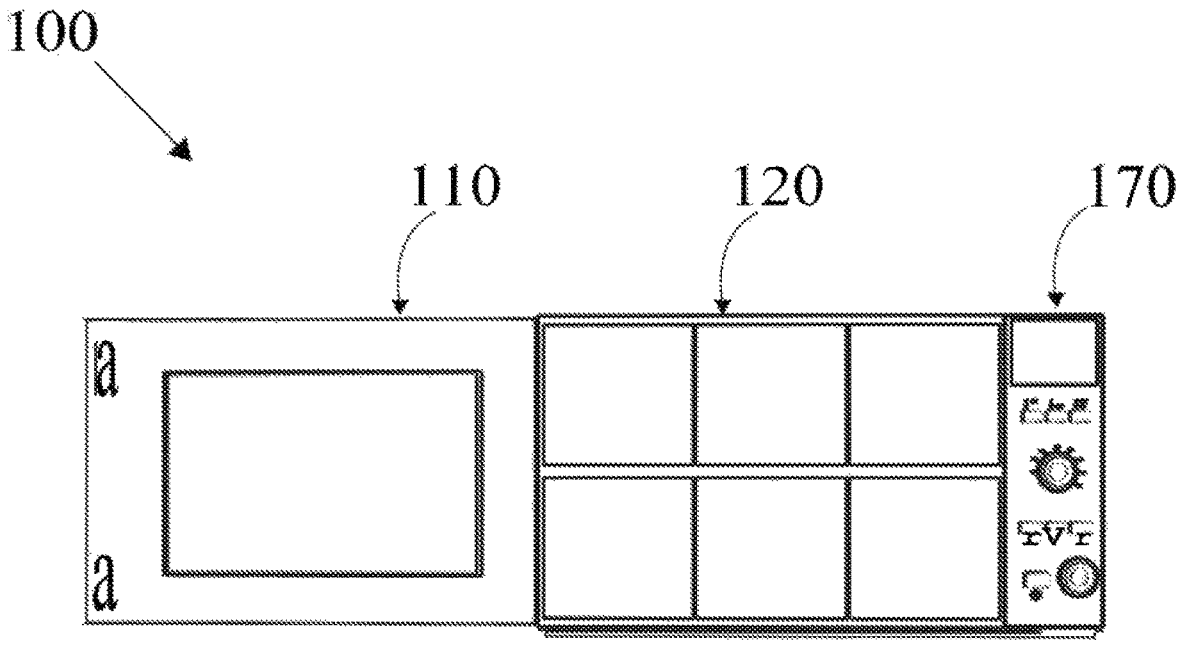
FIG. 5 is a front view of the present invention with the access door open in which at least one of the embodiments of the present invention is shown.
Figure 6:
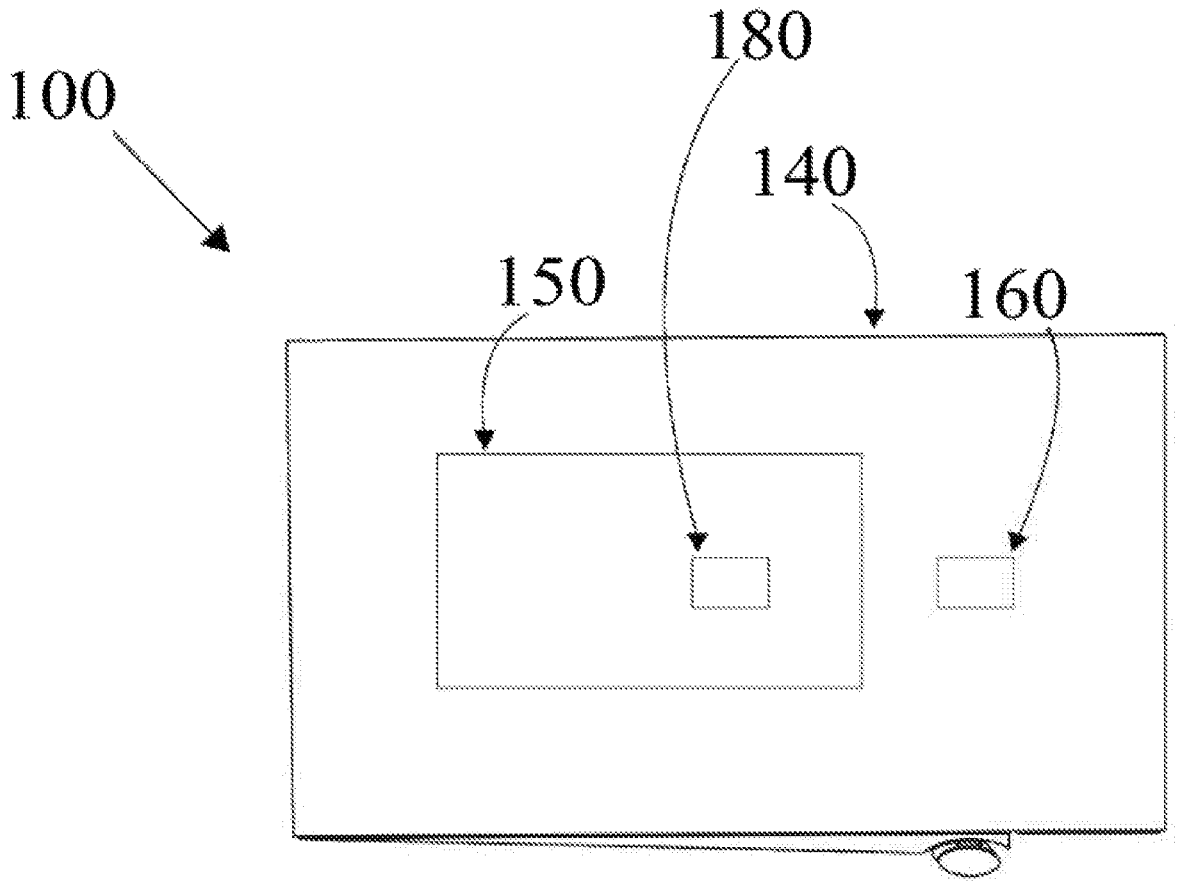
FIG. 6 is a top view of the present invention showing the location of a scale, a bar code scanner, and an infrared temperature sensor in which at least one of the embodiments of the present invention is shown.

FIG. 4 shows a front view of the device 100 with the access door 110 closed and display panel 170. FIG. 5 shows a front view of the device 100 with the access door 110 open and the display panel 170. Also, FIG. 5 shows at least one cooling compartment 120 that allows a food or beverage product to be placed in it. FIG. 6 shows a top view of the present invention and the location of the scale 150, a bar code scanner 180, and an infrared temperature sensor 160.

A microprocessor integrated within the device may calculate an algorithm that may include a look-up table to determine the density of the product based on the type of product as determined by the bar code scanner 180 to determine the amount of time that is required based on the density of the product and other characteristics.

Figure 7:
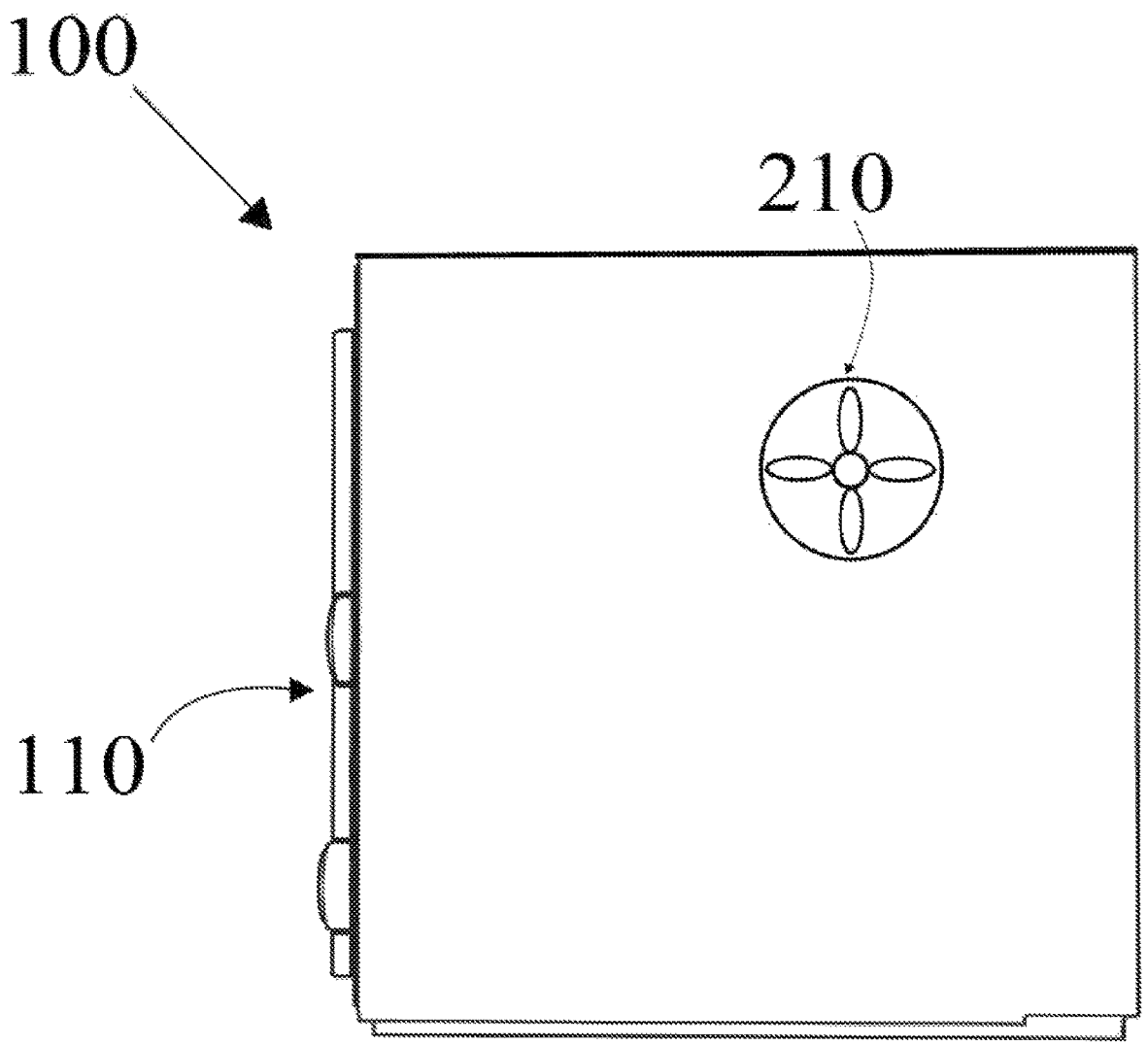
FIG. 7 is a side view of the present invention in which at least one of the embodiments of the present invention is shown.

FIG. 7 shows a side view of the device 100 with the access door 110 closed.

In at least one embodiment of the invention, a cooling compartment 120 may contain at least one cooling agent, including, but not limited to, dry ice and LN2. Dry ice may be chosen as the cooling agent due to its ability to last 5 to 10 days depending on the insulation within the device 100 in which it is placed. If dry ice is used for cooling, it will need to be periodically placed inside the device 100. While dry ice is generally safe to use as a cooling method, some caution should be considering when handling due to its extremely cold temperature, which may cause skin burns, since its temperature hovers around −109° F.

LN2 may also be used as the cooling agent. LN2 may further lower the temperature inside the cooling compartment 120 of the device 100, since its temperature ranges from −320.5° F. to −346° F. The user may choose a cooling agent that suits their needs for the temperature that they wish to obtain. If LN2 is used for cooling, it may be piped from an external tank located outside the device 100 to at least one cooling compartment 120 within the device 100.

In at least one alternative embodiment, the device 100 may use little or no electricity to cool the food or beverage product where the sensors operate on battery power. In another alternative embodiment, a nominal amount of electricity may be used to power the timer, thermocouple, controls, lights, etc.

In at least one embodiment of the present invention, at least one bar code scanner 180 may be placed within each cooling compartment 120 within the device 100. When the bar code scanner 180 detects that a food or beverage product has been placed in the cooling compartment 120, a valve may activate to bring the flow of LN2 into the cooling compartment 120 to cool the food or beverage product for a period of time calculated by an algorithm that is in part based on the density and other characteristics of the particular product.

In at least one embodiment of the present invention, at least one infrared temperature sensor 160 may be placed within each cooling compartment 120 within the device 100. When the infrared temperature sensor 160 detects that the temperature of a food or beverage product being placed in the cooling compartment 120 is at a higher temperature than a predetermined setting, a valve may activate to bring the flow of LN2 into the cooling compartment 120 to cool the product for a period of time calculated by an algorithm that considers the weight of the product and other factors.

In at least one embodiment of the present invention, at least one scale 150 may be placed in the bottom of each cooling compartment 120 within the device 100. When the scale detects weight from a food or beverage product being placed in the cooling compartment 120, a valve may activate to bring the flow of LN2 into the cooling compartment 120 to cool the product for a period of time calculated by an algorithm that considers the weight of the product and other factors.

In at least one embodiment of the present invention, the LN2 valve may be prevented from opening unless a scale in the bottom of the cooling compartment 120 is also activated, which will signal that a food or beverage product was placed in the cooling compartment 120 by measuring its weight.

In at least one embodiment of the present invention, at least one sensor may be placed within a compartment 120 within the device 100. When a food or beverage product has been placed in the cooling compartment 120, the sensor is triggered. When this occurs, a valve may be activated to allow for the flow of LN2 into the cooling compartment 120 area to cool the product. This may prevent LN2 from activating prior to a product being placed inside the device 100.

In at least one embodiment of the present invention, a thermostat or temperature measuring instrument may measure the temperature inside the device 100.

In at least one other embodiment of the present invention, there may also be a fan inside the device 100 to assist in producing a consistent temperature throughout the device 100 to allow for even cooling.

In at least one embodiment, the LN2 valve may remain closed until the door 110 of the device 100 is closed. This may prevent LN2 from flowing prior to a product being placed inside the device 100.

In at least one other embodiment, the LN2 valve may not open until both an item is placed in the cooling compartment 120 and the door 110 is closed. An item being placed in the cooling compartment 120 may be determined by a scale 150 that determines the weight of the item, an infrared temperature sensor 160 that determines the temperature of the item, a bar code scanner 180 that senses the type of item, or a combination of all of these methods.

In at least one embodiment of the present invention, there may be a timer to determine the amount of time that a food or beverage product needs to be kept inside the device 100 to reach the desired temperature. The time is calculated by an algorithm that may also consider the initial temperature inside the device 100, the initial temperature of the product, the weight of the food or beverage product through the use of a scale 150, the density of the food or beverage product with a bar code scanner 180 or a predetermined density, and the temperature of the LN2, dry ice, or other substance to be used for the cooling. In this manner, the algorithm may determine the cooling time required to allow the food or beverage product to reach the user's desired temperature.

In at least one embodiment of the present invention, a user may set a timer based on an estimate of the cooling time required for a food or beverage product to reach a desired temperature.

In at least one embodiment of the present invention, a thermocouple or other temperature measuring device 100 may be placed inside the device 100 to measure the temperature of a product in the device 100 to inform the user of when it reaches the desired temperature.

The device 100 of the present invention may be manufactured out a plurality of materials, including, but not limited to plastics, glass, rubber, metals, nickel, copper, aluminum, lead, silver, and other alloys or combination of materials. Any material used in the interior of the device 100 needs to be able to withstand the ultra-cold temperatures of LN2, dry ice, a cold alcohol gel, or a combination of one or more of these.

In at least one embodiment of the present invention, a vent 200 with an exhaust fan 210 is connected from the vicinity of the device 100 to the outside atmosphere to provide for the removal of nitrogen gas ("N2") from the area surrounding the device 100. This may assist in avoiding the buildup of N2 to avoid the possibility of nitrogen asphyxiation. It is possible that a small amount of LN2 can vaporize rapidly to large volumes of N2, where the sudden evaporation of LN2 into N2 in a limited space can lead to oxygen ("O2") depletion in the air. If the O2 concentration in the surrounding area drops below approximately ten percent (10%), a person may lose consciousness and become asphyxiated. Therefore, it is a very important that any N2 be vented to the outside atmosphere.

In at least one embodiment of the present invention, the vent 200 and connected exhaust fan 210 may automatically turn on whenever either the LN2 valve is opened from the LN2 tank, the device 100 is operating to cool the food or beverage, or the O2 sensor detects that the O2 concentration drops below a predetermined level.

In yet another alternative embodiment, a fan 210 connected to the vent 200 may be automatically activated to vent N2 directly to the outside atmosphere, if the O2 level in the vicinity of the device 100 drops below a predetermined level.

In yet another alternative embodiment, when the LN2 warms from a liquid to a gaseous state, the device 100 may vent the N2 gas via an exhaust fan 210 to the outside atmosphere to avoid nitrogen asphyxiation. The device 100 may also have an O2 sensor and alarm mounted on its exterior that is programmed to alarm when O2 levels begin to reach an unsafe level, so that there is sufficient time for a person to increase ventilation or evacuate the area.

In yet another alternative embodiment, the cooler may comprise a table at the bottom of the cooling compartment 120 to rotate the food or beverage product to allow for even cooling.

While certain embodiments have been shown and described, it will be understood that there is no intent to limit the invention by such disclosure, but rather, is intended to cover all modifications and alternate constructions falling within the spirit and scope of the invention as defined in the appended claims.

All of these embodiments and the invention disclosed herein are intended to be within the scope herein disclosed. These and other embodiments of the invention will become readily apparent to those skilled in the art from the detailed description of the preferred embodiments having reference to the attached figures, the embodiments not being limited to any particular, preferred embodiments disclosed. Also, the invention disclosed herein suitably may be practiced in the absence of any element which is not specifically disclosed herein.

Although the invention has been explained in relation to its preferred embodiment, it is to be understood that many other possible modifications and variations can be made without departing from the spirit and scope of the invention.

What is claimed is:

1. A rapid cooling device, comprising:

an insulated container having a topside, bottomside, and four sides, comprising:

at least one door; wherein the door automatically opens to avoid a food or beverage product from cooling to a temperature that is too low;

at least one cooling compartment capable of holding a cooling agent selected from the group consisting of liquid nitrogen, dry ice, and a solution of water and alcohol in a pack;

a scale that is attached to the topside of the insulated container, wherein the scale is capable of measuring a weight of a food or beverage product;

an external temperature sensor that is attached to the topside of the insulated container, wherein the external temperature sensor is capable of measuring an initial temperature of a food or beverage product with infrared;

an internal temperature sensor that is mounted inside of the insulated container, wherein the internal temperature sensor is capable of measuring an initial temperature inside of the insulated container;

a barcode scanner that is mounted on the outside of the insulated container, wherein the barcode scanner is capable of determining a density and type of food or beverage product;

an exhaust vent that is used to direct nitrogen gas outside of the insulated container;

wherein a food or beverage product is ejected from the bottom or any side of the insulated container to avoid a food or beverage product from cooling to a temperature that is too low;

wherein a flow of liquid nitrogen is stopped when the food product reaches a desired temperature to avoid a food or beverage product from cooling to a temperature that is too low; and wherein the external temperature sensor, the scale, and bar code scanner are combined together so that the initial weight, initial temperature, density, and type of food or beverage product may be determined by a user placing the product on top of the device.

2. The rapid cooling device of claim 1, further comprising an algorithm run by a microprocessor that is mounted within the insulated container, wherein the algorithm is capable of determining the amount of time that a food product needs to remain inside of the insulated container by calculating the final temperature of a food product based on an initial temperature inside the insulated container, along with a weight determined by the scale, density determined by the bar code scanner, and initial temperature of a food product placed inside the insulated container determined by the temperature sensor, and the temperature of the LN2, dry ice, or other substance to be used for the cooling that the food product is exposed to.

3. The rapid cooling device of claim 1, further comprising a timer that is mounted outside of the insulated container, wherein the time is calculated by an algorithm run by a microprocessor that considers the initial temperature inside the insulated container, the initial temperature of the food product, the weight of the food or beverage product through the use of a scale, the density of the food product through the use of a bar code scanner, and the temperature of the cooling agent so that the timer is capable of determining an amount of time that a food product needs to remain inside of the insulated container.

4. The rapid cooling device of claim 1, further comprising an alarm that is mounted on the outside of the insulated container, wherein the alarm is capable of alerting a user when a timer reaches a calculated amount of time that a food or beverage product needs to remain inside of the insulated container.

5. The rapid cooling device of claim 1, further comprising an exhaust fan that is activated when a timer expires to avoid a food product from cooling to a temperature that is too low.

6. The rapid cooling device of claim 1, wherein dry ice is ejected from the insulated container when a food or beverage product reaches a desired temperature to avoid the food product from cooling to a temperature that is too low.

7. The rapid cooling device of claim 1, wherein a gel-like ice pack is ejected from the insulated container when a food or beverage product reaches a desired temperature to avoid the food product from cooling to a temperature that is too low.

* * * * *